US005649445A

United States Patent [19]

Lavoie et al.

[11] Patent Number: 5,649,445

[45] Date of Patent: Jul. 22, 1997

[54] PIGGYBACK SET OF I-BEAM CONNECTOR DIES

[75] Inventors: Raymond Lavoie; David P. Gouveia, both of Manchester, N.H.

[73] Assignee: Burndy Corporation, Norwalk, Conn.

[21] Appl. No.: 439,783

[22] Filed: May 12, 1995

[51] Int. Cl.[6] ..... B21D 37/02

[52] U.S. Cl. ..... 72/413; 72/473; 72/409.16; 72/482.92; 81/423

[58] Field of Search ..... 72/413, 409.16, 72/473, 477, 482.92, 482.93, 157; 81/421–423

[56] References Cited

U.S. PATENT DOCUMENTS

| | | | |
|---|---|---|---|
| 794,249 | 7/1905 | Peterson | 81/422 |
| 2,444,599 | 10/1948 | Genter . | |
| 2,474,940 | 7/1949 | Hansen | 81/423 |
| 2,746,327 | 5/1956 | Runde | 72/409.16 |
| 3,276,236 | 10/1966 | McDowell | 72/157 |
| 3,363,219 | 1/1968 | Hubbard et al. . | |
| 3,830,427 | 8/1974 | Polidori . | |
| 4,236,398 | 12/1980 | Schwarze | 72/157 |
| 4,384,753 | 5/1983 | Mixon, Jr. . | |
| 4,641,516 | 2/1987 | Satoh | 72/482.93 |
| 4,780,096 | 10/1988 | Franks, Jr. . | |
| 4,784,621 | 11/1988 | Auclair . | |
| 4,828,504 | 5/1989 | Franks, Jr. . | |
| 4,993,959 | 2/1991 | Randolph . | |
| 5,113,727 | 5/1992 | Foster | 81/421 |
| 5,240,423 | 8/1993 | Morrison . | |
| 5,243,883 | 9/1993 | Savage | 81/421 |

*Primary Examiner*—Daniel C. Crane
*Attorney, Agent, or Firm*—Hoffman Wasson & Gitler

[57] ABSTRACT

A set of dies for crimping the connector to a structural member, such as an I-beam. The set of dies includes a pair of crimping dies provided within a compression for crimping tool. A pair of removable embossing dies is inserted into the crimping tool to initially emboss the surfaces of an I-beam flange. The embossing dies are removed and the connector is installed on the flange of the I-beam. The tool is positioned over the connector, and the crimp is made. Henceforth, pressure is applied to the tool by the crimping dies which would then crimp the connector in place.

6 Claims, 2 Drawing Sheets

PIGGYBACK SET OF I-BEAM CONNECTOR DIES

FIELD OF THE INVENTION

The present invention is directed to a pair of dies used in a crimping tool for affixing a connector to a structural member, such as an I-beam.

BACKGROUND OF THE INVENTION

U.S. Pat. No. 5,240,423 issued to Morrison and assigned to Burndy Corporation is directed to a grounding connector capable of being clamped by compression forces to a tapered metallic flange of an I-beam. However, while this patent deals with the connector which is affixed to the structural beam, there is very little description relating to the means for installing the connector to the beam.

U.S. Pat. No. 2,444,599 issued to Genter; U.S. Pat. No. 4,384,753 issued to Mixon, Jr; U.S. Pat. No. 4,784,621 issued to Auclair and U.S. Pat. No. 4,828,504 issued to Franks, Jr. describe various devices for attaching a connector to a structural member, such as I-beam.

For example, the patent to Mixon, Jr. discloses an electrical-connector comprising two inner members movably positioned between the legs of an U-shaped outer member with the facing surfaces of the inner members and legs having cooperating, passage-forming grooves into which a conductor may be positioned. Upon driving the connector onto an edge of a metallic framework, the inner members are driven outwardly against the legs to crimp the conductors, which may be positioned in the passages as shown in FIGS. 4 and 5. Teeth provided on the inwardly facing surfaces of the inner members are adapted to grip the edge of the framework to retain the connector thereon.

The patent to Genter discusses a rail flange clamp employing a set screw with a hardened tip to engage the tapered surface of the flange by virtue of rotational forces imparted to the set screw by a lug wrench.

The patent to Auclair relates to a wire connector for ground wires employing a pair of jaw members adapted for clamping to an I-beam, shown in FIG. 4. A head assembly includes a threaded shaft for securing the jaw members in a clamping relationship. A bifurcated slot extends to the head assembly. The slot is selectively dimensioned to receive a ground wire which is secured in a fixed position by a set screw.

Finally, the Franks, Jr. patent details a clamping device having a U-shaped portion between which material is positioned to be mechanically, and electrically, coupled to the clamp when engaged. One inner surface of the U-shaped clamp includes a conically-shaped tip of hardened material, which is positioned directly opposed to a threaded bolt or stud extending outwardly from the opposed inner surface of the U-shaped clamp for engagement with the tip. The terminal end of the opposite lead position threaded bolt is formed with a complimentary recess and, preferably, a knurled or serrated outer edge for abrading material, which is engaged in upon the tightening of the bolt.

However, none of these references disclose a device consisting of two pairs of dies which are utilized to emboss one or more surfaces of the structural member and then crimp a connector to the structural member.

SUMMARY OF THE INVENTION

The deficiencies of the prior art are overcome by the present invention which is directed to an embossing die set which sits in a piggy back fashion on a crimping die set retained within a crimping tool in order to emboss the flange of a structural member, such as an I-beam. The embossing dies can be removed from the tool, leaving the conventional crimping dies in place, after the embossing operation has been completed. The embossing dies rely upon a series of pyramids to prepare the surface of the flange to receive a grounding connector of the type shown in U.S. Pat. No. 5,240,423. A grounding connector is capable of being clamped, by the compressive forces applied by the crimping dies, onto the flat or tapered metallic flange of the I-beam. Prior to embossing the structural member, a rotating grinding wheel is applied to the site to assist in the removal of rust, scale or other excess matter which is on the surface of the structural member. Subsequent to this grinding operation, the embossing operation would assist in preparing the site for the mounting of the connector, thereby providing the connector with a better grip on the flange of the beam. The embossing dies include a backstop which assures that the embossing operation occurs at a proper distance from the edge of the flange.

BRIEF DESCRIPTION OF THE DRAWINGS

Further objects of invention together with additional features contributing thereto and advantages accruing therefrom will be apparent from the following description of a preferred embodiment of the invention which is shown in the accompanying drawings with like reference numerals indicating corresponding parts therethrough wherein.

DETAILED DESCRIPTION OF THE PRESENT INVENTION

Figure 1:
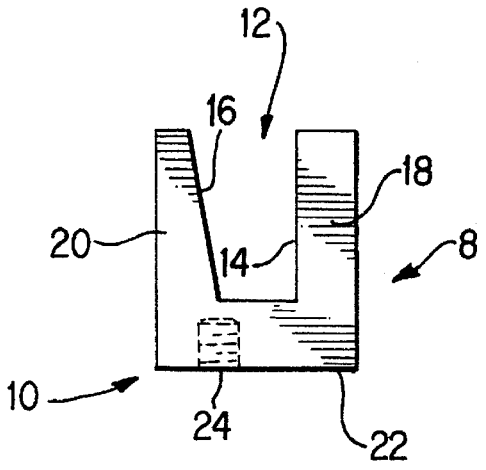
FIG. 1 is an end view of a typical grounding connector which is to be affixed to a structural member, such as an I-beam.
Figure 2:
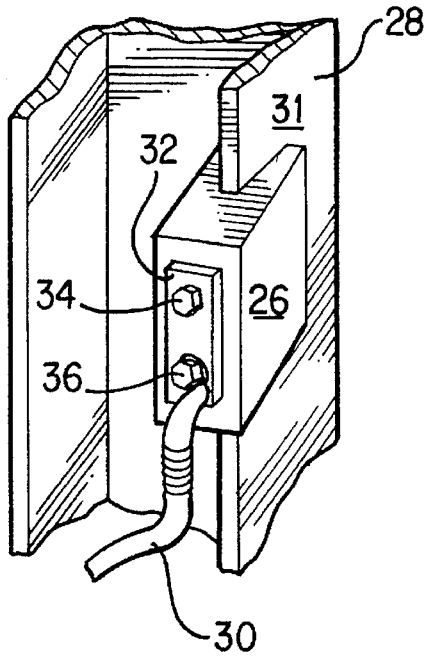
FIG. 2 is a perspective view of the connector shown in FIG. 1. after installation.

A typical compressible grounding connector 8 is shown in FIG. 1. The grounding connector is provided with two opposed end surfaces 10. Each end surface is provided with a base section 22 and two leg sections 18 and 20 formed to provide a slot 12 between the leg sections 18, 20. Side sections 14 and 16 of the connector cooperate to provide a tapered slot 12 to conform to the geometry of a typical I-beam 28 provided with a flange 31 having a straight side surface as well as an angled surface (see FIG. 2). The connectors are also provided with a rectangular top surface 26. When installed, as shown in FIG. 2, the connector can also include a terminal 32 provided with two hex nuts and two lock washers 34, 36 to affix a conductor or cable 30 to the connector. Set screws (not shown) are also used to mount the terminal 32 in place.

Figure 3:
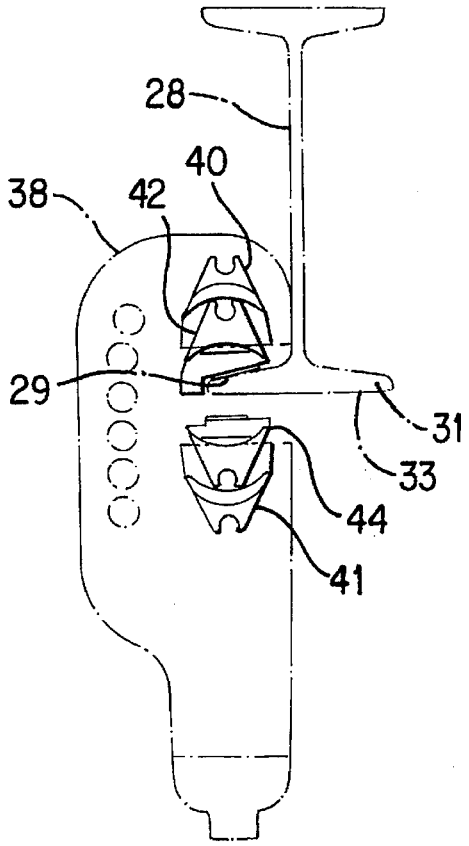
FIG. 3 is a side view of both sets of dies.
Figure 4:
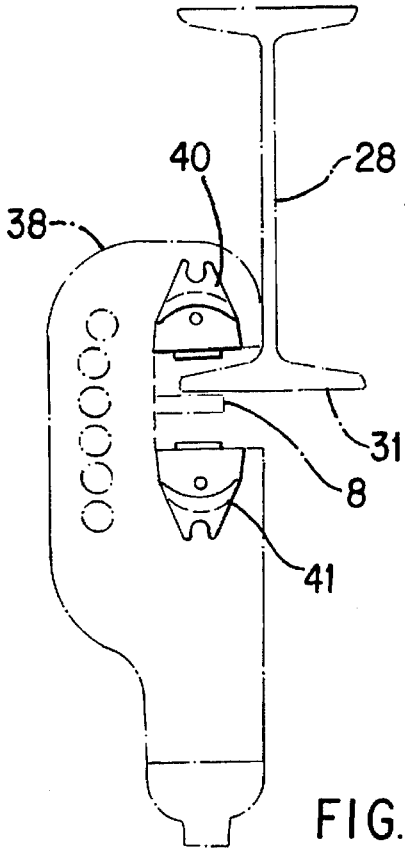
FIG. 4 is a side view of the crimping dies after the embossing dies have been removed.

FIGS. 3 and 4 illustrate the assembly of the pairs of dies. FIG. 3 illustrates a typical crimping tool 38 (shown in phantom) provided with the two sets of dies included in the head of the tool. The type of crimping tool which was utilized is standard in nature such as the Y46. The only requirement that the crimping tool must have is that it must be able to be provided with two sets of dies, one set of two dies provided in the top portion of the tool and the second set of two dies provided in the bottom portion of the tool. As shown in FIG. 3, a top embossing die 42 is provided in the tool 38 such that when the head of the tool is compressed, the embossing die 42 will come into contact with an angled surface 29 of the flange 31 of the I-beam 28. A bottom embossing die 44 is provided in the tool 38 in such a manner that comes in contact with a straight portion 33 of the flange 31 when pressure is applied to the crimping tool 38. Top and bottom crimping dies 40, 41 are provided in a "piggy back" configuration with embossing dies 42, 44 respectively. In this context, it is noted that the embossing dies cannot be used by themselves. Each embossing die must sit on its respective crimping die in order to properly fit into the crimping tool.

This type of configuration would assure a good electrical grounding when used in conjunction with the I-beam connectors shown in FIG. 1. The "piggy back" mounting of the embossing dies would reduce the distance that the tool ram will have to travel in order to emboss the flange of the beam utilizing the embossing dies 42, 44. Once the embossing phase of the I-beam preparation has been completed, the embossing dies 42, 44 are removed, exposing the crimping dies, 40, 41 which are used to crimp the connector onto the flange of the I-beam. These dies are held in place using the current pin and button assembly found on the standard Y46 crimping tool. This feature is shown in more detail in FIGS. 5–8.

Figure 5:
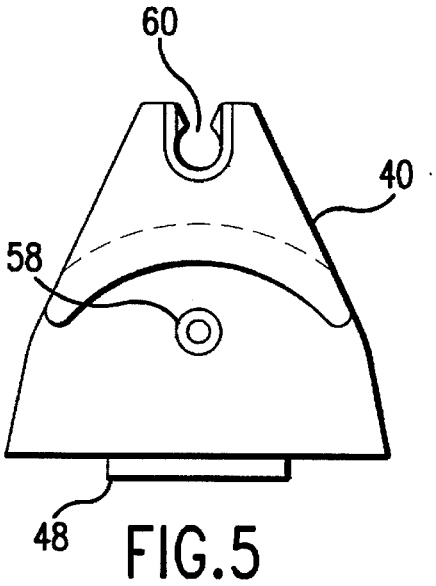
FIG. 5 is a side view of one of the crimping dies.
Figure 7:
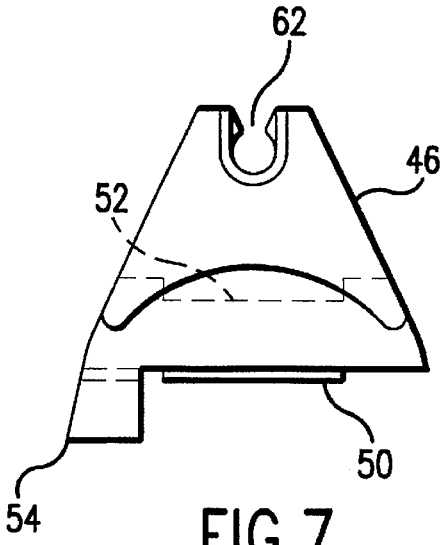
FIG. 7 is a side view of a second type of embossing die.
Figure 6:
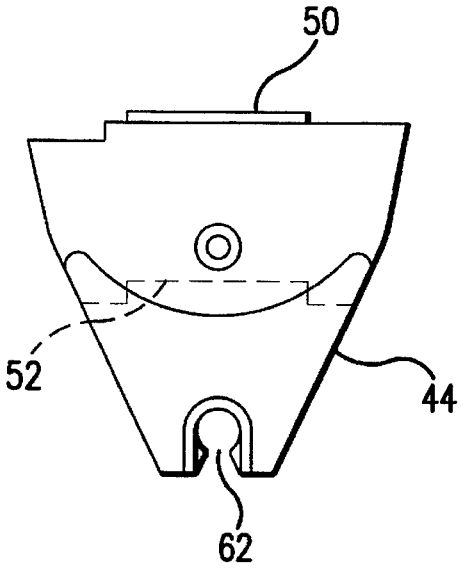
FIG. 6 is a side view of one of the embossing dies.
Figure 8:
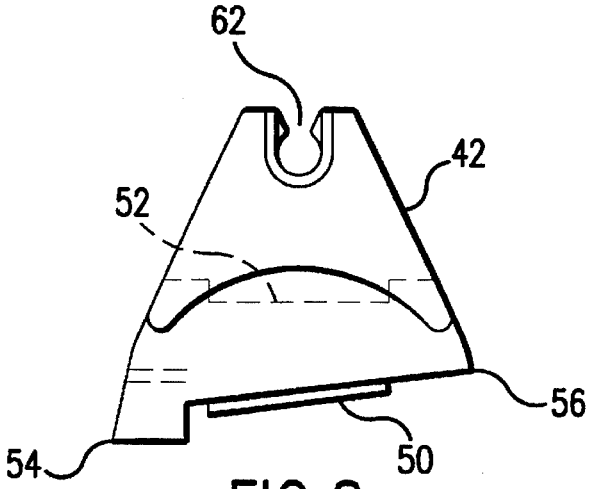
FIG. 8 is a side view of a third type of embossing die.

As shown in FIG. 5, the crimping die 40 (as well as die 41) is provided with a pin 58. Each of the embossing dies 42, 44 and 46 shown in FIGS. 6, 7 and 8 are provided with a aperture 62 into which the pin 58 is inserted to affix the embossing dies 42, 44 or 46 to the crimping dies 40 or 41. It is noted that the crimping dies 40 and 41 are also provided with an aperture 60 for mounting onto the Y46 tool. The pin 58 is spring loaded in such a manner as to engage the embossing dies so that they remain in place during the embossing operation. A button is depressed which would move the pin away from the embossing dies to allow these dies to be removed from the tool. The utilization of this pin and button assembly is advantageous over the typical dovetail or mechanical fastener, because no tools are required to remove the embossing dies, allowing the removal of the dies manually even when one has gloves on.

Each of the embossing dies is provided with a pyramid 50 used to help prepare the flange surface of the I-beam to receive the connector. Since many of the I-beams are provided with a single angled surface 29, the embossing die 42 shown in FIG. 8 would be utilized since it includes a cooperating angled surface 56. However, if neither of the surfaces of the flange 31 is angled, the embossing die 46 shown in FIG. 7 would be utilized instead of embossing die 42. In both instances, embossing die 44 would be used on the bottom die of the embossing die set. Both of the embossing dies 42 and 46 are provided with a backstop 54 extending from the bottom surface of the die, beyond the pyramid portion 50. This backstop assures that the embossing is located the proper distance from the edge of the flange 31. It is noted that the pyramids 50 are used to upset the mounting site of the connector and provide the connector with a better grip on the flange 31 of the beam. The undersurface 52 of each of the embossing dies 42, 44 and 46 are constructed so as to receive a crimping pad 48 provided on the crimping die 40. This would allow the embossing dies to be properly aligned with the crimping die as well as the center line of the tool. Furthermore, the height of the crimping piece 48 and the depth of the undersurface 52 are sized to transfer the full force of the crimping tool through the dies to the surface of the structural member. In this instance, the pins 58 would not "see" any load during the embossing operation.

In operation, both a pair of crimping dies as well as a pair of embossing dies are provided in the head of a crimping tool as shown in FIG. 3. At this point, the pair of embossing dies face one another and the pair of crimping dies are provided in the head of a tool such that one of the crimping dies is provided on top of one of the embossing dies and the second crimping die is provided under the second embossing die. The crimping tool is then moved to the structural member, such as the I-beam and pressure is applied so that the embossing dies come into contact with the flange of the I-beam. Pressure is applied to the crimping tool so that the top and bottom surface of the flange become roughened to provide a better grip to the connector.

At this point, pressure is removed from the compression tool and the crimping tool is then removed from the area of the I-beam. Pins 58 are then manually disengaged from the crimping tool to remove the embossing dies therefrom, thereby leaving a pair of opposed crimping dies. The connector 8 is then inserted onto the I-beam. The crimping tool is positioned over the connector, and force is applied to make the crimp between dies 40 and 41. The two surfaces of the connector 8 then engage the flange of the I-beam 28 and pressure is applied to crimp the inner surfaces of the connector to the flange of the I-beam.

While a preferred embodiment of the foregoing invention has been set forth for purposes of illustration, the foregoing description should not be deemed limitation of the invention herein. Accordingly, various modifications, adaptations and alternatives may occur to one skilled in the art without departing from the spirit and scope of the present invention.

What is claimed is:

1. A die set to be used with a compression tool having first and second head portions for securing a connector to a flange of a structural member, the flange provided with an outside edge, the die set comprising:

a pair of opposed embossing dies removably provided within the head portions of the compression tool, one of said embossing dies provided within the first head portion of the compression tool and one of said embossing dies provided within the second head portion of the compression tool, each of said embossing dies provided with a top surface, each of said embossing dies further provided with a means for embossing a surface of the flange, thereby creating a roughened surface on the flange surface thereon when pressure is applied to the compression tool with the structural member placed between said pair of embossing dies;

a pair of opposed crimping dies fixedly attached to the head portions of the compression tool, one of said crimping dies provided with a bottom surface which abuts said top surface of one of said embossing dies and one of said crimping dies provided with a bottom surface which abuts said top surface of said second embossing die, when said pair of embossing dies are provided in the head portion of the compression tool, wherein said pair of crimping dies crimp the connection to the flange of the structural member when pressure is applied to the compression tool after the roughened surface is created and the connector and flange of the structural member are placed between said pair of crimping dies;

a means for removably attaching one of said embossing dies to one of said crimping dies and for removably attaching the second of said embossing dies to the second of said crimping dies.

2. The set of dies in accordance with claim 1 wherein said means for removably attaching said embossing dies to said crimping dies includes a spring loaded pin.

3. The set of dies in accordance with claim 2 wherein each of said embossing dies is provided with an aperture through which said pin passes to secure each of said embossing dies to each of said crimping dies respectively.

4. The set of dies in accordance with claim 1 in which each of said embossing dies is provided with a surface complimentary to the flange surface of the structural member.

5. The set of dies in accordance with claim 4 in which one of said surfaces of said embossing dies is angled with respect to the horizontal.

6. The set of dies in accordance with claim 1 where each of said embossing dies is provided with a backstop for properly locating each of said embossing dies at an appropriate distance from the outside edge of the flange during an embossing operation.

* * * * *